US008297707B2

(12) United States Patent
Wu

(10) Patent No.: US 8,297,707 B2
(45) Date of Patent: Oct. 30, 2012

(54) MOVABLE SUPPORT LEG

(76) Inventor: Yao-Chuan Wu, Chiayi Hsien (TW)

( * ) Notice: Subject to any disclaimer, the term of this patent is extended or adjusted under 35 U.S.C. 154(b) by 99 days.

(21) Appl. No.: 12/954,642

(22) Filed: Nov. 25, 2010

(65) Prior Publication Data

US 2012/0133191 A1 May 31, 2012

(51) Int. Cl.
*A47C 16/02* (2006.01)

(52) U.S. Cl. ..... 297/423.45; 297/423.46

(58) Field of Classification Search ..... 297/338, 297/4, 344.18, 195.11, 461, 423.44, 423.46, 297/423.45, 181; D6/358
See application file for complete search history.

(56) References Cited

U.S. PATENT DOCUMENTS

| | | | | |
|---|---|---|---|---|
| 1,392,144 | A * | 9/1921 | Gray | 248/170 |
| 3,141,701 | A * | 7/1964 | Wilkins | 297/423.46 |
| 5,622,403 | A * | 4/1997 | Gonda | 297/19 |
| 6,752,459 | B2 * | 6/2004 | Deisig | 297/316 |
| 2008/0157583 | A1 * | 7/2008 | Boren et al. | 297/452.48 |

FOREIGN PATENT DOCUMENTS

EP 209852 A2 * 1/1987

* cited by examiner

*Primary Examiner* — Milton Nelson, Jr.
(74) *Attorney, Agent, or Firm* — Alan Kamrath; Kamrath IP Lawfirm, PA

(57) ABSTRACT

A movable support leg contains a base, a column disposed on the base, a holding surface fixed on the column. The holding surface is fixed and capable of adjusting its height and angle by using first and second rods and the column. A top end of each of the first and the second rods is axially connected with the holding surface by using one screw, and a bottom end of each of the first and the second rods adjusts its height to be fixed on the column.

18 Claims, 6 Drawing Sheets

MOVABLE SUPPORT LEG

BACKGROUND OF THE INVENTION

1. Field of the Invention

The present invention relates to office furniture and, more particularly, to a movable support leg.

2. Description of the Prior Art

A conventional movable support leg is provided on which a user's two legs are placed when he or she sits at an office to comfort the legs. However, such a movable support leg can not adjust its height and an angle of a holding surface to comfort the legs.

Therefore, an improved movable support leg to be portable easily and to adjust its height and angle is necessary.

The present invention has arisen to mitigate and/or obviate the afore-described disadvantages.

SUMMARY OF THE INVENTION

The primary object of the present invention is to provide a movable support leg that is portable easily and is capable of adjusting a height and an angle of the holding surface to comfort a user's legs.

Another object of the present invention is to provide a movable support leg that is stored in a small size when the movable support leg is not used.

To obtain the above objectives, a movable support leg provided by the present invention contains a base, a column disposed on the base, and a holding surface fixed on the column. The holding surface is fixed and capable of being adjusting its height and angle by using first and second rods and the column. A top end of each of the first and the second rods is hinged with the holding surface, and a bottom end of each of the first and the second rods adjusts its height to be fixed on the column. The first rod is formed by selecting from a V-shaped and a straight rod shape, and the second rod is formed by selecting from a V-shaped and a straight rod shape. When the first rod is formed in a V-shape and the second rod is straight, two top ends of two sides of the first rod are hinged with the holding surface individually, a bottom end of two sides of the first rod is connected with the column by a sliding member, a top end of the second rod is hinged with the holding surface, and a bottom end of the second rod is fitted onto the column. When the second rod is formed in a V shape and the first rod is straight, two top ends of two sides of the second rod are hinged with the holding surface individually, a bottom end of the two sides of the second rod is fitted onto the column, a top end of the first rod is hinged with the holding surface, and a bottom end of the first rod is connected with the column by the sliding member.

When the first rod and the second rod are formed in a V shape, two top ends of two sides of the first rod and the second rod are hinged with the holding surface respectively, a bottom end of two sides of the first rod is fixed on the column by a sliding member, and a bottom end of two sides of the first rod is fitted onto the column.

When the first rod and the second rod are straight and the holding surface includes an extension extending downward therefrom and formed by selecting from V and circular arc shapes, a top end of the second rod is hinged with the holding surface, a top end of the first rod is hinged with the extension of the holding surface, a bottom end of the first rod is fixed on a column by using the sliding member, and the bottom end of the first rod is fitted onto the column.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
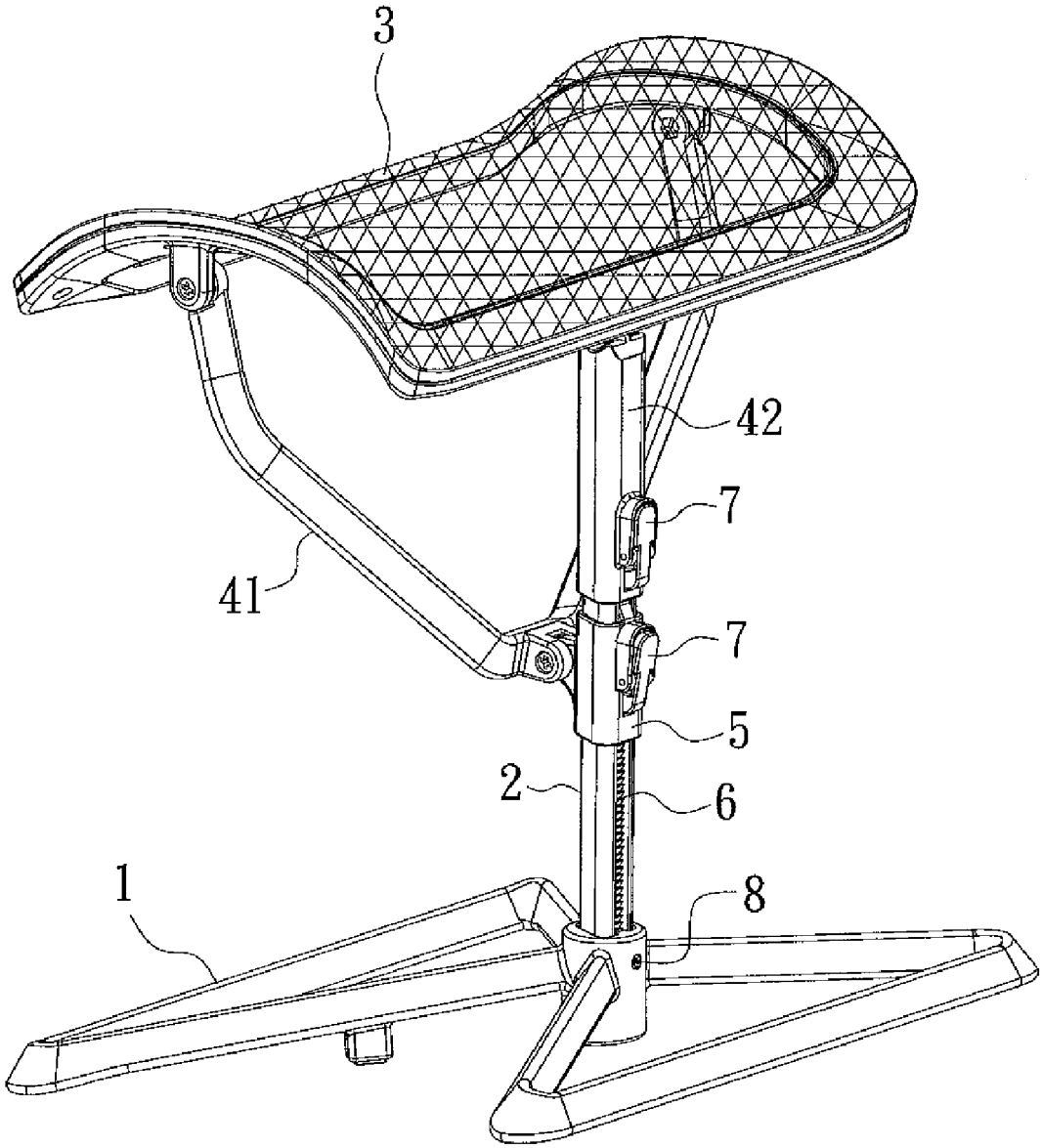
FIG. 1 is a perspective view showing the assembly of a movable support leg according to a first embodiment of the present invention.
Figure 2:
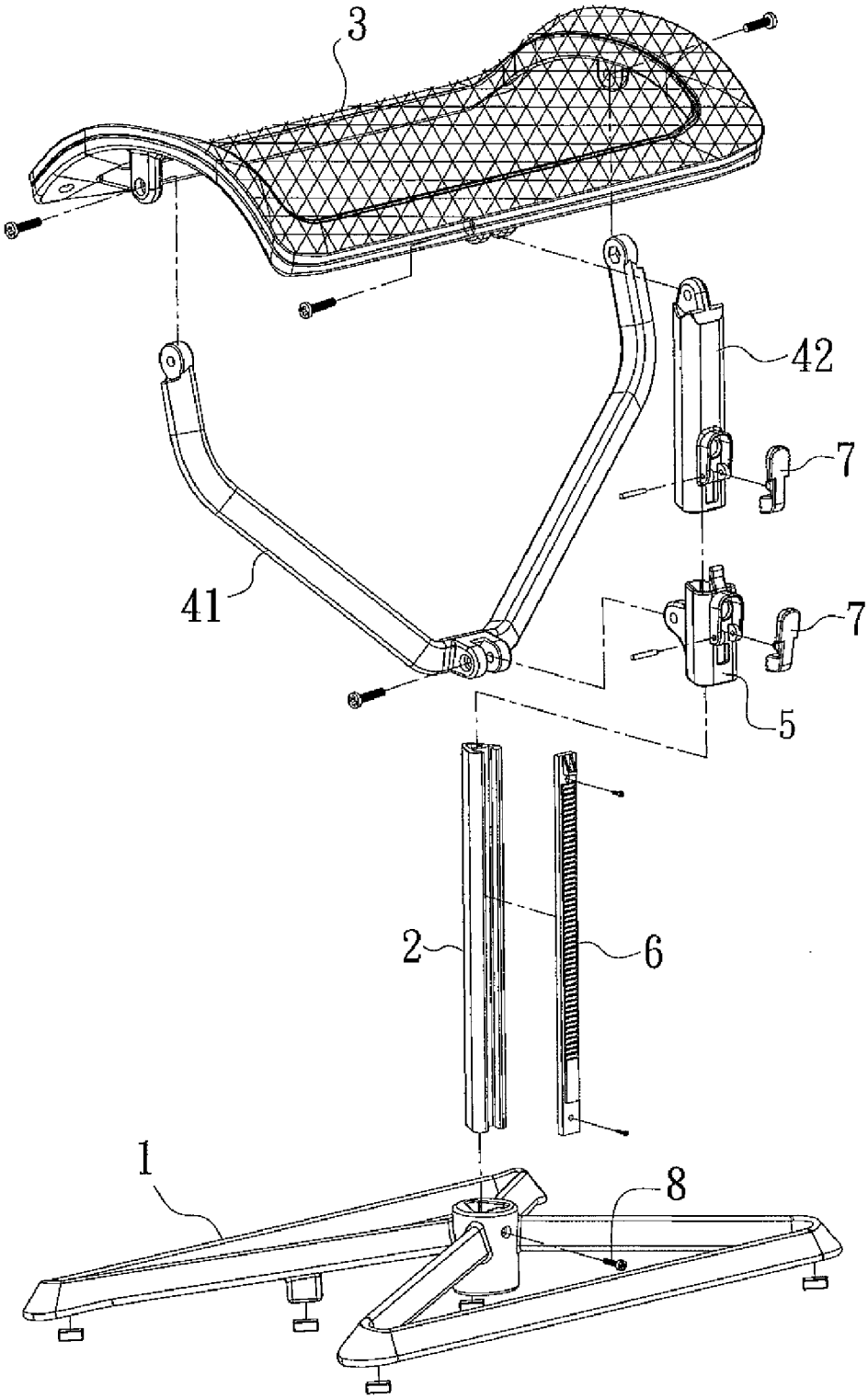
FIG. 2 is a perspective view showing the exploded components of the movable support leg according to the first embodiment of the present invention.

With reference to FIGS. 1-2, a movable support leg according to a first embodiment of the present invention comprises a base 1, a column 2 disposed on the base 1, and a holding surface 3 fixed on the column 2. The holding surface 3 is fixed and capable of adjusting its height and angle by using first and second rods 41, 42 and the column 2. A top end of each of the first and the second rods 41, 42 is axially connected with the holding surface 3 by using screws 8, and a bottom end of each of the first and the second rods 41, 42 adjusts its height to be fixed on the column 2.

When the first rod 41 is formed in a V shape and the second rod 42 is straight, two top ends of two sides of the first rod 41 are axially connected with the holding surface 3 individually by using two screws 8, a bottom end of the two sides of the first rod 41 is connected with the column 2 by a sliding member 5, a top end of the second rod 42 is axially coupled with the holding surface 3 by one screw 8, and a bottom end of the second rod 42 is fitted onto the column 2.

The column 2 includes a positioning strap 6 with a plurality of teeth, and the sliding member 5 is adjusted upward or downward for being further fixed on the positioning strap 6 by using a retainer 7. The second rod 42 fitted onto the column 2 is adjusted upward or downward for being further fixed on the positioning strap 6 by means of the retainer 7.

Each of the teeth of the positioning strap 6 is formed by selecting from triangle, rectangle, and trapezium shapes, and one of the three acute angles of the tooth faces upward so that the positioning strap 6 is used to position the sliding member 5 and the second rod 42 securely.

The holding surface 3 is curved or flat and made by selecting from soft net, cloth, and feather materials to comfort a user's legs.

A cross section of the column 2 is formed in a triangle shape, and the base 1 is formed in a figure 8 shape. The column 2 and the base 1 are connected together by using one screw 8.

Figure 3:
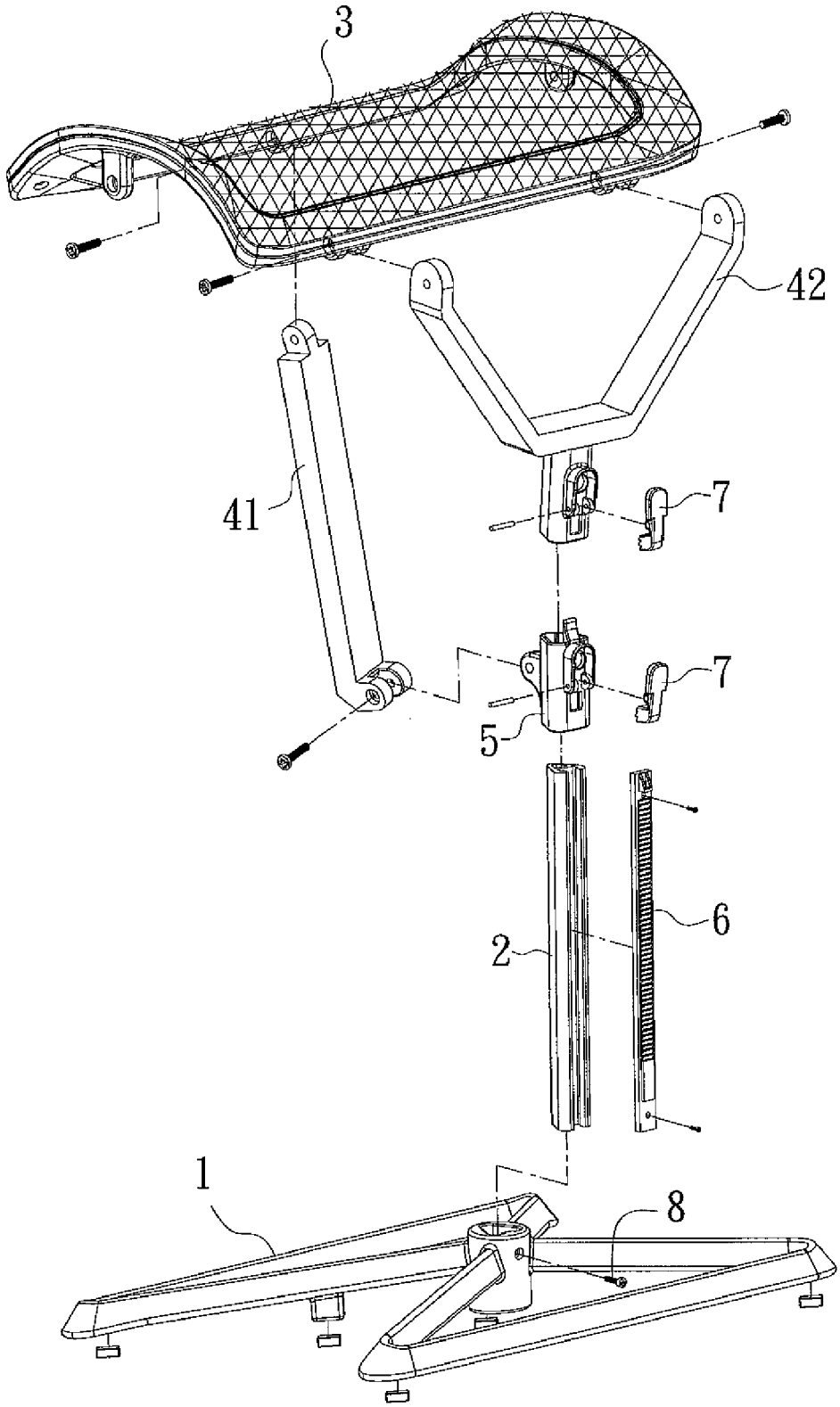
FIG. 3 is a perspective view showing the exploded components of a movable support leg according to a second embodiment of the present invention.

Referring to FIG. 3, a difference of a movable support leg according to a second embodiment of the present invention from that of the first embodiment comprises a first rod 41 and a second rod 42. When the second rod 42 is formed in a V shape and the first rod 41 is straight, two top ends of two sides of the second rod 42 are axially connected with a holding surface 3 by two screws 8 individually, a bottom end of the two sides of the second rod 42 is fitted onto a column 2, a top end of the first rod 41 is axially coupled with the holding surface 3 by one screw 8, and a bottom end of the first rod 41 is connected with the column 2 by a sliding member 5.

Figure 4:
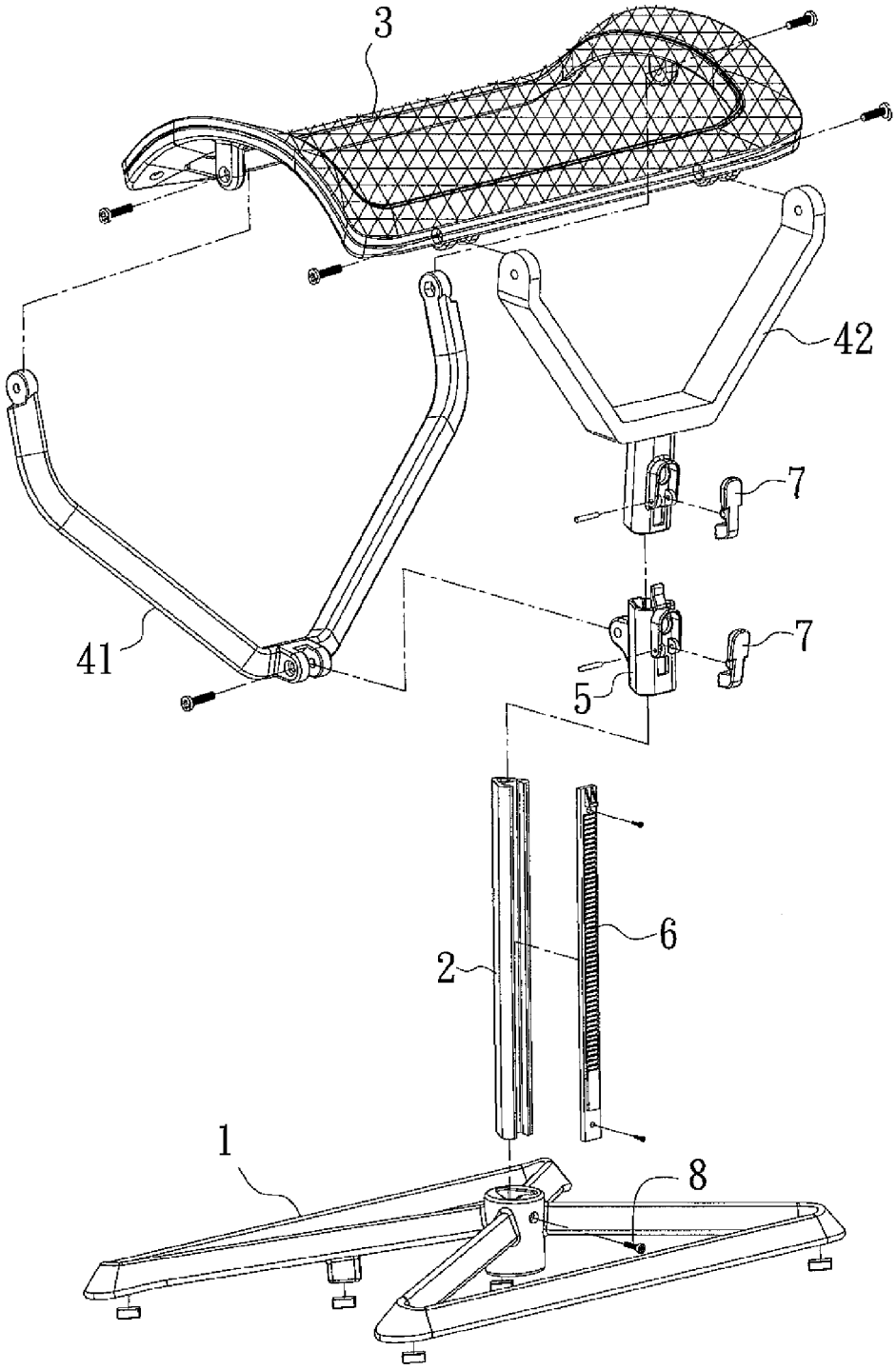
FIG. 4 is a perspective view showing the exploded components of a movable support leg according to a third embodiment of the present invention.

As shown in FIG. 4, a difference of a movable support leg according to a third embodiment of the present invention from that of the first embodiment comprises a first rod 41 and a second rod 42. When the first rod and the second rod 41, 42 are formed in a V shape, two top ends of two sides of the first rod and the second rod 41, 42 are axially connected with a holding surface 3 by using two screws 8 respectively, a bottom end of the two sides of the first rod 41 is fixed on a column 2 by a sliding member 5, and a bottom end of the two sides of the second rod 42 is fitted onto the column 2.

Figure 5:
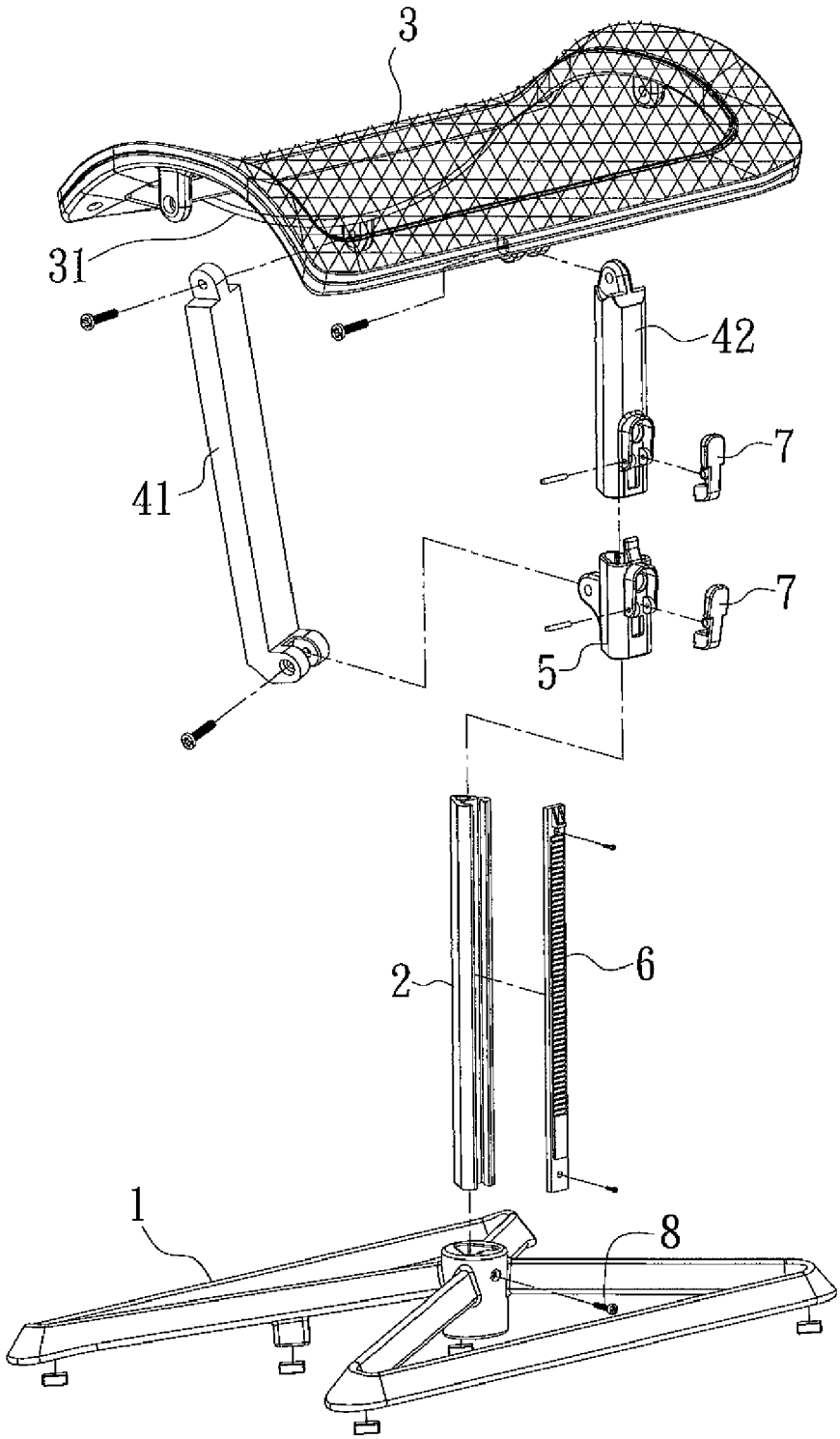
FIG. 5 is a perspective view showing the exploded components of a movable support leg according to a fourth embodiment of the present invention.

As illustrated in FIG. 5, a difference of a movable support leg according to a fourth embodiment of the present invention from that of the first embodiment comprises a first rod 41, a second rod 42, and a holding surface 3. When the first rod and the second rod 41, 42 are straight and the holding surface 3 includes an extension 31 extending downward therefrom and formed in a V shape or a circular arc shape, a top end of the second rod 42 is axially coupled with the holding surface 3 by using one screw 8, a top end of the first rod 41 is axially connected with the extension 31 of the holding surface 3 by using one screw 8, a bottom end of the first rod 41 is fixed on a column 2 by using a sliding member 5, and a bottom end of the second rod 42 is fitted onto the column 2.

Figure 6:
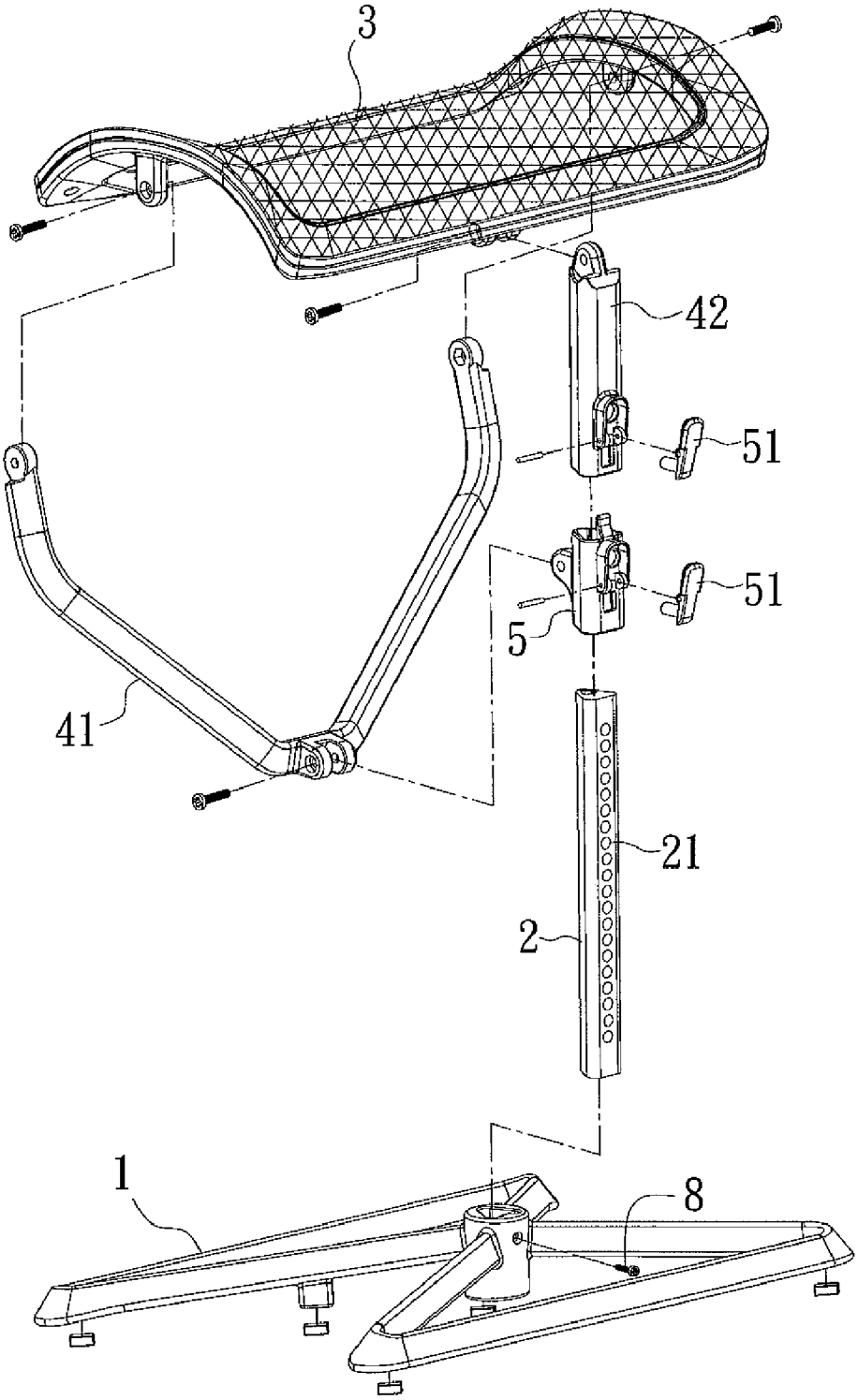
FIG. 6 is a perspective view showing the exploded components of a movable support leg according to a fifth embodiment of the present invention.

Referring to FIG. 6, a difference of a movable support leg according to a fifth embodiment of the present invention from that of the first embodiment comprises a column 2 having a plurality of holes 21. Each hole is formed by selecting from circle, square, and ellipse shapes, but it is preferably formed in a circle shape. A sliding member 5 is adjusted upward or downward to be further fixed to one of the holes 21 by a bolt element 51, and a second rod 42 fitted on the column 2 is adjusted upward or downward to be further fixed to another of the holes 21 by using another bolt element 51.

While various embodiments in accordance with the present invention have been shown and described, it is clear to those skilled in the art that further embodiments may be made without departing from the scope of the present invention.

What is claimed is:

1. A movable support leg comprising:

a base, a column disposed on the base, and a holding surface adjustably fixed on the column, wherein a height and an angle of the holding surface relative to the column are adjustable by using first and second rods and the column, wherein a top end of each of the first and second rods is axially connected with the holding surface by using one screw, wherein a bottom end of each of the first and second rods is adjustably fixed on the column, wherein the first rod is formed by selecting from a V shape and a straight rod shape and the second rod is formed by selecting from a V shape and a straight rod shape; wherein when the first rod is formed in the V-shape and the second rod is straight, two top ends of two sides of the first rod are axially connected with the holding surface by using two screws individually, a bottom end of the two sides of the first rod is connected with the column by a sliding member, a top end of the second rod is axially coupled with the holding surface by one screw, and a bottom end of the second rod is fitted onto the column; and wherein when the second rod is formed in the V shape and the first rod is straight, two top ends of two sides of the second rod are axially connected with the holding surface individually by using two screws, a bottom end of the two sides of the second rod is fitted onto the column, a top end of the first rod is axially coupled with the holding surface by using one screw, and a bottom end of the first rod is connected with the column by the sliding member.

2. The movable support leg as claimed in claim 1, wherein the holding surface is curved and made by selecting from soft net, cloth, and feather materials.

3. The movable support leg as claimed in claim 1, wherein the holding surface is flat and made by selecting from soft net, cloth, and feather materials.

4. The movable support leg as claimed in claim 1, wherein the cross section of the column is formed in a triangle shape, wherein the base is formed in a figure 8 shape, and wherein the column and the base are connected together by using one screw.

5. The movable support leg as claimed in claim 1, wherein the column includes a positioning strap with a plurality of teeth, wherein the sliding member is adjusted upward or downward for being further fixed on the positioning strap by using a retainer, and wherein the second rod fitted onto the column is adjusted upward or downward for being further fixed on the positioning strap by the retainer.

6. The movable support leg as claimed in claim 5, wherein each of the plurality of teeth of the positioning strap is formed by selecting from triangle, rectangle, and trapezium shapes.

7. The movable support leg as claimed in claim 1, wherein the column has a plurality of holes, wherein the sliding member is adjusted upward or downward to be further fixed to one of the plurality of holes by a bolt element, and wherein the second rod fitted on the column is adjusted upward or downward to be further fixed to another of the plurality of holes by using another bolt element.

8. The movable support leg as claimed in claim 7, wherein each hole of the positioning strap is formed by selecting from circle, square, and ellipse shapes.

9. The movable support leg as claimed in claim 1, wherein when the first and second rods are straight and the holding surface includes an extension extending downward therefrom and formed by selecting from V and circular arc shapes, the top end of the second rod is axially connected with the holding surface by one screw, the top end of the first rod is axially coupled with the extension of the holding surface by using one screw, the bottom end of the first rod is fixed on the column by using the sliding member, and the bottom end of the second rod is fitted onto the column.

10. The movable support leg as claimed in claim 9, wherein the column has a plurality of holes, wherein the sliding member is adjusted upward or downward to be further fixed to one of the plurality of holes by a bolt element, and wherein the second rod fitted on the column is adjusted upward or downward to be further fixed to another of the plurality of holes by using another bolt element.

11. The movable support leg as claimed in claim 10, wherein each hole of the positioning strap is formed by selecting from circle, square, and ellipse shapes.

12. The movable support leg as claimed in claim 9, wherein the column includes a positioning strap with a plurality of teeth, wherein the sliding member is adjusted upward or downward for being further fixed on the positioning strap by using a retainer, and wherein the second rod fitted onto the column is adjusted upward or downward for being further fixed on the positioning strap by the retainer.

13. The movable support leg as claimed in claim 12, wherein each of the plurality of teeth of the positioning strap is formed by selecting from triangle, rectangle, and trapezium shapes.

14. The movable support leg as claimed in claim 1, wherein the first and second rods are each formed in the V shape, the two top ends of the two sides of the first and second rods are axially connected with the holding surface respectively by using two screws, the bottom end of the two sides of the first rod is fixed on the column by the sliding member, and the bottom end of the two sides of the second rod is fitted onto the column.

15. The movable support leg as claimed in claim 14, wherein the column has a plurality of holes, wherein the sliding member is adjusted upward or downward to be further fixed to one of the plurality of holes by a bolt element, and wherein the second rod fitted on the column is adjusted upward or downward to be further fixed to another of the plurality of holes by using another bolt element.

16. The movable support leg as claimed in claim 15, wherein each hole of the positioning strap is formed by selecting from circle, square, and ellipse shapes.

17. The movable support leg as claimed in claim 14, wherein the column includes a positioning strap with a plurality of teeth, wherein the sliding member is adjusted upward or downward for being further fixed on the positioning strap by using a retainer, and wherein the second rod fitted onto the column is adjusted upward or downward for being further fixed on the positioning strap by the retainer.

18. The movable support leg as claimed in claim 17, wherein each of the plurality of teeth of the positioning strap is formed by selecting from triangle, rectangle, and trapezium shapes.

* * * * *